US008613527B1

(12) United States Patent
Allen et al.

(10) Patent No.: US 8,613,527 B1
(45) Date of Patent: Dec. 24, 2013

(54) FRAC LIGHT 3000

(71) Applicant: A&P Support, Inc., Columbia Crossroads, PA (US)

(72) Inventors: Chris Allen, Columbia Crossroads, PA (US); Clifford Packard, Columbia Crossroads, PA (US)

( * ) Notice: Subject to any disclaimer, the term of this patent is extended or adjusted under 35 U.S.C. 154(b) by 0 days.

(21) Appl. No.: 13/710,674

(22) Filed: Dec. 11, 2012

(51) Int. Cl.
*F21V 33/00* (2006.01)

(52) U.S. Cl.
USPC ..... 362/234; 362/249.01

(58) Field of Classification Search
USPC ..... 362/249.01, 234, 310, 363; 446/220
See application file for complete search history.

(56) References Cited

U.S. PATENT DOCUMENTS 7,264,382 B2 * 9/2007 Yoshimori et al. ..... 362/431

* cited by examiner

*Primary Examiner* — David V Bruce
(74) *Attorney, Agent, or Firm* — Matthew T. Rogers

(57) ABSTRACT

An illumination balloon which has an inflatable bladder surrounding an assembly that includes a frame comprised of hollow tubes, lighting sources, and mechanical fan for inflating said bladder. The lighting sources are staggered along the frame so that each is unimpeded from the fixtures and bulbs of the other lighting sources. The mechanical fan does require a transformer to step up or step down the voltage received from an external power supply. Wiring to energize the lighting sources and mechanical fan are threaded through the hollow tubes of the frame.

7 Claims, 2 Drawing Sheets

FRAC LIGHT 3000

CROSS-REFERENCE TO RELATED APPLICATIONS

Not Applicable.

STATEMENT REGARDING FEDERALLY SPONSORED RESEARCH

Not Applicable.

BACKGROUND

1. Field of Invention

The present invention relates to devices used to provide illumination. In particular, the present invention relates to balloons used for illumination purposes.

2. Description of Related Art

There is a need in many technical fields for illumination of remote, outdoor areas during the nighttime. For example, in the field of oil and gas drilling, drilling operations typically occur 24 hours per day in remote areas. Strong illumination of the drilling rig and surrounding area is essential if such operations are to be conducted safely in the nighttime. All variety of portable lighting means are used at drill sites to accomplish this illumination. Examples include portable floodlights and light towers.

Another example is a illumination balloon. Illumination balloons are known and certain embodiments of illumination balloons are disclosed in U.S. Pat. Nos. 5,782,668, 6,012,826, 6,966,676, 7,252,414, and 7,611,395. Generally, illumination balloons comprise an outer, inflatable bladder with a lighting means positioned within the bladder. When the lighting means is energized, light is emitted through the bladder and out into the surrounding environment. Illumination balloons are preferred because they allow for light to be emitted 360° from the light source while at the same reducing the glare caused by high-powered lighting sources since the balloon's bladder somewhat diffuses the luminance of the lighting means.

However, there are several known deficiencies associated with illumination balloons presently known in the art. Known balloons are comprised of frames that are inherently weak and do not provide any protection for the electrical wiring that is typically routed around the frame. Second, known balloons do not maximize the efficiency of the lighting source due to the physical location of each individual lighting source relative to each other. Third, known balloons use an unnecessarily complicated means of energizing the inflating means of the balloon which increases costs and increases the risk of component failure.

SUMMARY

The present invention solves the aforementioned deficiencies. The first improvement over prior-art illumination balloons is the frame. The frame of the present invention is preferably constructed of aluminum with a minimum of three vertical pillars that are hollow to allow electrical wiring to be threaded through the frame. The lighting sources of the present invention are staggered along the vertical pillars of the frame so each lighting source may emit its own light unimpeded from the fixtures and bulbs of the other lighting sources. The inflating means of the present invention comprises a 110 V fan assembly that does not require a transformer to step down the voltage originating from the main power source. The present invention is further comprised of known components, including a translucent membrane that is supported by the frame and inflated by the inflating means. When the lighting sources are energized and the membrane inflated, the present invention produces 360° of light.

DETAILED DESCRIPTION

Figure 1:
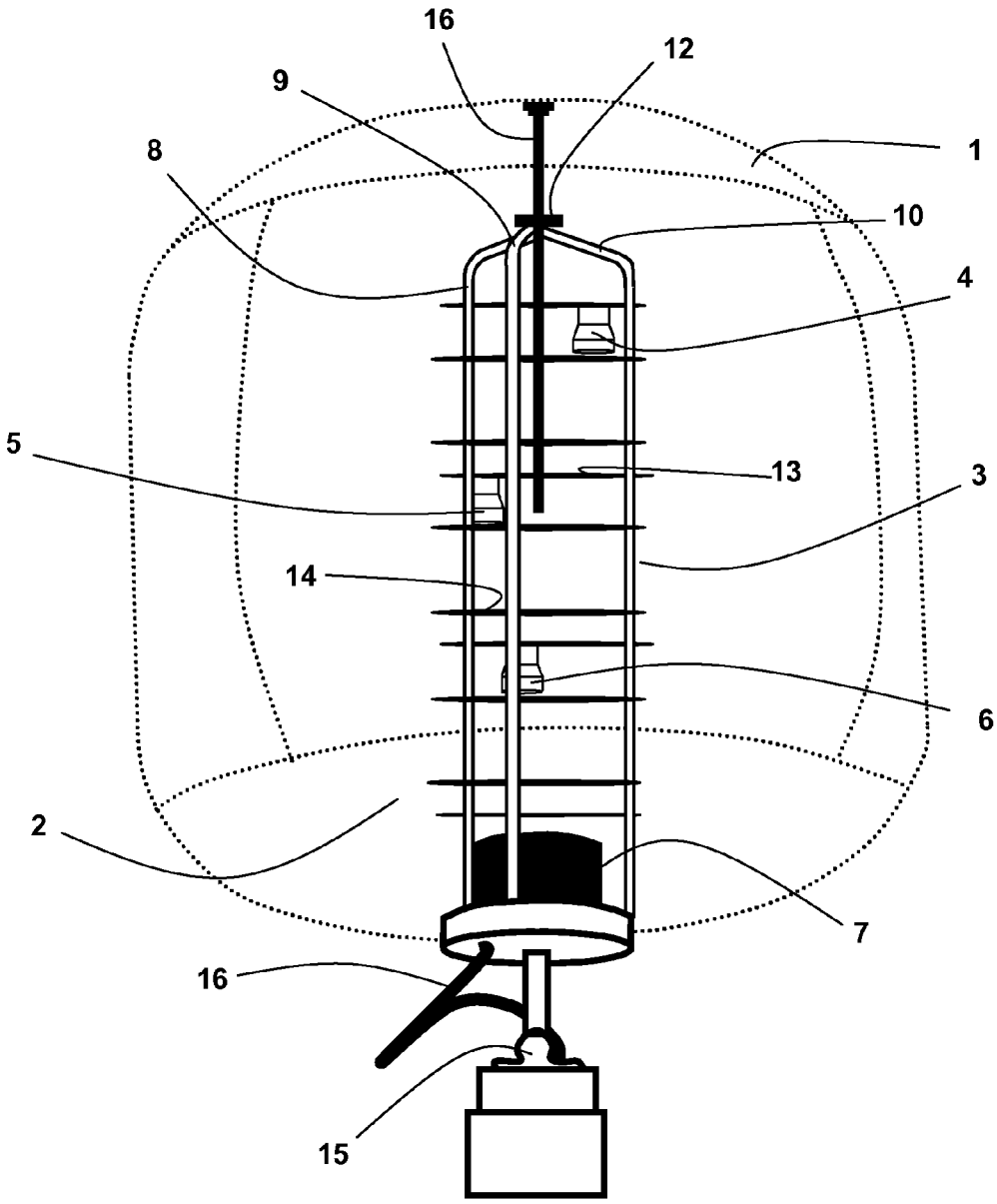
FIG. 1 is a side view of an illumination balloon embodying features of the present invention.

Referring to FIG. 1, an illumination balloon consistent with the present invention comprises an inflatable bladder 1 that envelops an assembly 2. The assembly comprises a frame 3, a plurality of light sources (4, 5, 6), and a mechanical fan 7. The frame 3 comprises three hollow tubes (8, 9, 10) mounted to a base plate 11 and welded to a ring 12 at the top of the frame 3, lamp base mounting plates 13, ring supports 14, pole mount 15, and an extension rod 16.

The inflatable bladder 1 may be constructed of any flexible, translucent material.

Preferably, the inflatable bladder 1 is made from Odyssey III™ coated polyester manufactured by MarChem CFI. In preferred embodiments of the present invention, the inflatable bladder 1 measures 4' in diameter and 39" in height, and at the base of the inflatable bladder 1, a 12" diameter opening is cut (not shown) which is reinforced along the edges of the opening by a 3" strip of vinyl. The base of the inflatable bladder 1 may be attached to the assembly 2 by any known means of attachment, but is preferably attached to the assembly 2 via eight mounting holes cut into the vinyl enforcement strip that are each then threaded around a bolt and then fastened to the assembly with a nut. In preferred embodiments, the inflatable bladder 1 comprises a standard zipper (not shown) along its height that allows a user to easily open the bag and gain access to the assembly 2 inside. Preferred embodiments of the inflatable bladder 1 also comprise one or more closing straps that snap to keep the inflatable bladder 1 wound against the assembly 2 when the bladder 1 is deflated (e.g., similar to closing straps on an umbrella that keep the umbrella wound when not in use).

Figure 2:
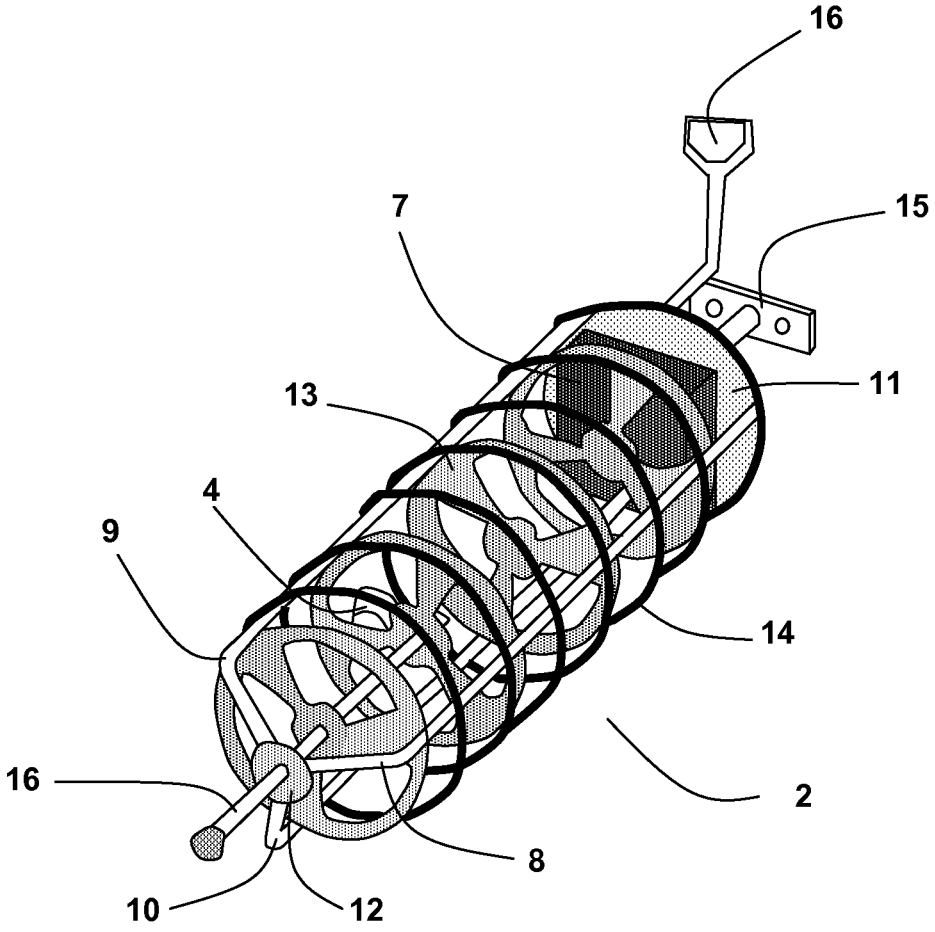
FIG. 2 is a perspective view of an assembly embodying features of the present invention.

Shown in FIG. 2, the frame 3 of the assembly 2 may be constructed of any solid material but is preferably constructed of aluminum. The three hollow tubes (8, 9, 10) are attached to a circular base plate 11 and top ring 12, both made of a solid material such as aluminum, via any permanent means of attachment such as welding. The tubes (8, 9, 10) are hollow to allow wiring 16 for the light sources (4, 5, 6) to be threaded through them and to each lamp base mounting plate 13. The hollow tubes (8, 9, 10) are preferably reinforced along there length by ring supports 14 which can be made of any solid material but are preferably made of aluminum. A pole mount 15 is attached to the underside of the base plate 11 by any permanent means of attachment such as welding. An extension rod 16 is threaded through and above the top ring 12 and functions to support the top of the inflatable bladder 1 and assist it in keeping its shape when inflated. As shown in FIG. 2, the extension rod 16 can be made to be adjustable along the length of the assembly 2 for ease of storage when the illumination balloon is not in use.

Referring back to FIG. 1, the present invention further comprises a minimum of three individual light sources (4, 5, 6). The light sources (4, 5, 6) may be any known means of producing electric light, such as incandescent light bulbs and light-emitting diodes. Wires 16 to deliver electric power enter the base plate 11 and are threaded through hollow tubes (8, 9, 10) of the frame 3 to the lamp base mounting plates 13. The lamp base mounting plates 13 are affixed to the frame 3 via any known means of permanent attachment. The light sources (4, 5, 6) are affixed to the lamp base mounting plates 13 in ways that are known in the art to allow the light sources (4, 5, 6) to receive the electric power delivered by the wires 16. As shown in FIG. 1, the light sources (4, 5, 6) are placed in staggered locations along the length of the frame 3. This allows each light source (4, 5, 6) to deliver light unimpeded by adjacent lighting sources and/or fixtures, as are found on known illumination balloons.

The present invention further comprises a mechanical fan 7 positioned at the base of the assembly 2. Importantly, the electric motor of the mechanical fan 7 of the present invention does not comprise a transformer to step down the voltage received from an external power supply, as is required in known illumination balloons. Said power supply may be any known power supply device such as grid power, a generator, a battery, or a solar cell. The lack of a transformer lowers the cost of manufacturing and maintaining the mechanical fan 7. The mechanical fan 7 is preferably an axial-flow fan that is mounted to the base plate 11 via any known permanent means of connection. Electric power is delivered to the mechanical fan 7 via the wires 16 threaded through the base plate 11 and hollow tubes (8, 9, 10).

While the invention has been described in conjunction with specific embodiments thereof it is evident that many alternatives, modifications and variations will be apparent to those skilled in the art. Accordingly, the preferred embodiments of the invention, as set forth herein, are intended to be illustrative, not limiting. Various changes may be made without departing from the true spirit and full scope of the invention, as defined in the following claims.

What is claimed is:

1. An illumination balloon, comprising:

(a) an inflatable bladder made of flexible, translucent material; and (b) an assembly comprised of a frame, a minimum of three (3) lighting sources, a mechanical fan to inflate said inflatable bladder, and wiring to energize said lighting sources and said mechanical fan, wherein said frame is comprised of at least three (3) hollow tubes made of metal, a base plate, and a pole mount, said plurality of light sources are positioned at staggered locations along said frame, and said mechanical fan does not require a transformer to step up or step down the voltage received from an external power supply.

2. The illumination balloon of claim 1, wherein said inflatable bladder is made of polyester.

3. The illumination balloon of claim 1, wherein said hollow tubes are made of aluminum.

4. The illumination balloon of claim 1, wherein said frame further comprises an extension rod.

5. The illumination balloon of claim 1, wherein said frame further comprises ring supports along the length of said hollow tubes.

6. The illumination balloon of claim 1, wherein said wiring is threaded through the interiors of said hollow tubes.

7. The illumination balloon of claim 1, wherein said inflatable bladder is further comprised of closing straps.

* * * * *